US008822799B2

(12) United States Patent
Dumitru

(10) Patent No.: US 8,822,799 B2
(45) Date of Patent: Sep. 2, 2014

(54) ERGONOMIC TRAINING/PRACTICE MALLET FOR KEYBOARD PERCUSSION

(76) Inventor: David Richard Dumitru, St. Louis, MO (US)

( * ) Notice: Subject to any disclaimer, the term of this patent is extended or adjusted under 35 U.S.C. 154(b) by 281 days.

(21) Appl. No.: 13/427,060

(22) Filed: Mar. 22, 2012

(65) Prior Publication Data

US 2012/0240747 A1 Sep. 27, 2012

Related U.S. Application Data

(60) Provisional application No. 61/465,737, filed on Mar. 24, 2011.

(51) Int. Cl.
*G10D 13/02* (2006.01)
*G10D 13/00* (2006.01)

(52) U.S. Cl.
CPC ..... *G10D 13/003* (2013.01)
USPC ..... 84/422.4

(58) Field of Classification Search
CPC ..... G10D 13/02; G10D 13/003
USPC ..... 84/422.4
See application file for complete search history.

(56) References Cited

U.S. PATENT DOCUMENTS 4,106,079 A * 8/1978 Drury ..... 362/34
5,218,152 A * 6/1993 Campbell et al. ..... 84/422.4
5,929,356 A * 7/1999 Piland et al. ..... 84/422.4
6,118,062 A 9/2000 Thoman
6,307,138 B1 * 10/2001 Simpson ..... 84/422.4
6,924,423 B2 8/2005 O'Donnell
7,595,442 B2 9/2009 Grover
7,741,552 B2 6/2010 Walker
2006/0027073 A1 2/2006 Richard

OTHER PUBLICATIONS http://www.music123.com/Concert-Percussion/Concert-Percussion-Accessories/Concert-Sticks-Mallets/Concert-Keyboard-Mallets/Ensemble-Series-Fiberglass-Marimba-Mallets.
site7prod442896.product (fiberglass "two-Stage"mallets).
http://www.americandrum.com/catalog/therapy/crobbins.html (Example of a mallet with pommels, but not intended for multi-mallet keyboard percussion. i.e., the mallet is for a drum and the pommel is not meant to be grasped).

* cited by examiner

*Primary Examiner* — Kimberly Lockett

(57) ABSTRACT

A training and practice mallet for keyboard percussion instruments comprising a slender, substantially cylindrical mallet shaft with a gripping end and a striking end, the gripping end improved and enhanced with a pommel, or knob, affixed to the gripping end terminus, the pommel (knob) of suitable size to be gripped in the user's hand without impeding multi-mallet manipulation, and the striking end improved with a lightweight mallet head whereby a reduced volume is produced when striking a keyboard percussion instrument and in turn reducing fatigue and irritation in the user's hands and wrists. The training and practice mallet allows for increased control and confidence at low volumes while learning complex four-mallet grips. A pommel as described above and fitted to a conventional mallet for keyboard percussion instruments.

17 Claims, 4 Drawing Sheets

ERGONOMIC TRAINING/PRACTICE MALLET FOR KEYBOARD PERCUSSION

CROSS REFERENCE

This patent application refers to and clarifies a provisional patent application filing, information for which is as follows: Application No. 61/465,737 Filing Date: Mar. 24, 2010 Applicant: David Dumitru.

STATEMENT REGARDING FEDERALLY SPONSORED RESEARCH OR DEVELOPMENT

NA

FIELD OF INVENTION

The instant invention relates to the field of musical instruments, specifically pertaining to keyboard percussion instruments such as the marimba, xylophone, vibraphone, and orchestra bells, and more specifically pertaining to mallets for striking said instruments to produce a desired sound with a desired physical effect. More specifically still, the instant invention relates to mallets which facilitate the practice and training in, and improvement of, the skills necessary to become proficient in the playing of and performance on said instruments.

BACKGROUND

Students, teachers and practitioners of the unique skills required to play that family of percussion instruments known as keyboard percussion instruments face a particular set of challenges unique to this area of musical study and performance. The instant invention, an ergonomic, training/practice mallet for keyboard percussion addresses several of these challenges, and while it is foreseen that one or more innovations herein described, particularly the pommeled handle discussed below, will also have applications beyond training and practice, it is these challenges that are of primary concern at this writing. One such challenge is that an advanced study of the keyboard percussion instruments requires the percussionist to learn and become proficient at independently manipulating four or more mallets at a time, with a minimum of two mallets per hand, utilizing said mallets to strike the surface of a percussion instrument such as the marimba or vibraphone to create chords and complex melodic and harmonic sequences. Several methods, or grips, have been promulgated over time to facilitate this learning, including the "traditional" grip, the Musser grip, the Stevens grip and the Burton grip. Acquiring and becoming proficient in any of these methods of gripping and manipulating keyboard percussion mallets necessitates extended rehearsal sessions in which the percussionist learns to manipulate each mallet as an independent member. The acquisition of this skill requires significant development of fine motor control and neuro-muscular coordination.

Traditionally this training has been accomplished using a standard keyboard percussion mallet comprising a striking member (or mallet head) which strikes the striking surface of the instrument and which is attached to one end of a slender, substantially cylindrical shaft typically made of one of a variety of hardwoods or synthetic materials, or rattan. Furthermore traditionally, the end of the mallet shaft which the percussionist grasps is simply a continuation of the body of the shaft with no substantial improvement or change in diameter or construction along the length of the shaft. While many modifications have been made with respect to drumsticks and mallets for other percussion instruments, few have been discovered which address the particular limitations and constraints of mallets for keyboard percussion instruments, such as constraints on the diameter of the mallet shaft so that two or more mallets might be grasped in each hand and manipulated independently. The Musser company, for example, produces a 'two-stage' fiberglass mallet for keyboard percussion instruments (the M6-M12 model line, for instance) essentially comprising two mallet shaft members of substantially elongated cylindrical shape, the shaft member to which the mallet head is attached being slightly smaller in diameter than the gripping member. The mallet does not however address the concerns of the instant invention in that traditionally the mallet shaft has comprised a single piece of uniform diameter upon which the mallet head is mounted at one end. This arrangement can prove problematic when the student transitions from two mallet playing in which a single mallet is held in each hand with the hand fully encompassing the diameter of each mallet, to the more advanced techniques of four mallet playing, which requires the percussionist to grasp the mallet shafts at the extreme terminus or end opposite the mallet head in order to utilize the greatest possible length of each mallet shaft in order to strike large intervals between notes and to minimize interference between and among portions of the mallet shafts grasped in the percussionist's hands.

This arrangement has proven problematic in terms of pedagogic facility for a number of reasons. Firstly, the mallet shaft of most traditional keyboard percussion mallets ranges in diameter from just under 5/16 of an inch to perhaps a little more than three-eighths of an inch. This leaves very little surface area for the percussionist to gain purchase with his or her grip and with which to control the mallet through the range of axes required especially when required to manipulate each mallet independently of the others. As might be intuited, at the beginning and well into the training for four mallet techniques, the acquisition of the skills required to master the techniques can be extremely awkward and ungainly. The instant invention addresses this particular challenge through the use of a knob, or pommel, at the butt end of the mallet shaft to provide the percussionist with substantially increased surface area for grasping (the butt end being the end of the mallet grasped by the percussionist while playing) while simultaneously preserving the slender diameters of the mallet shafts to minimize interference between mallets being independently manipulated. Thereby the present invention provides increased control over each individual mallet for the student and practitioner.

The increased surface area the instant invention provides, through the use of a pommel or grasping knob, also improves awareness of the mallets' orientation in space by providing greater tactile input from the hand to the brain, increasing both the confidence the percussionist possesses regarding the orientation of the mallet and the feeling of control over the mallet. This increased confidence can be crucial both for students of percussion and for teachers of percussion as it allows a student to concentrate more on the music and less on the specific orientation of the mallet. While the current emphasis of the invention is on providing a method for training, rehearsing, and practice for students of keyboard percussion instruments, it will be noted that the benefits mentioned above will accrue across the spectrum of skill levels, from beginners to accomplished professionals and that application, either in manufacture or in retrofitting, of the pommeled or knobbed grip to mallets designed for performance as well as for rehearsing will be entertained and are hereby expressly foreseen and claimed below.

An additional challenge for percussionists in the early stages of their training as well as throughout their careers is that keyboard percussion mallet-building technique has typically resulted in mallets of considerable weight. This is especially problematic for younger practitioners. The weight of the mallet head can shape the percussionist's experience of the instrument in at least two ways which the instant invention seeks to address. These involve ease of mallet control, and the volume level in terms of the sound produced when the mallet strikes the striking surface.

Mallet control as pertains to mallet head weight: Typically, traditional keyboard mallet construction is achieved by attaching a core of cork, plastic, rubber, or wood to one end of the mallet shaft, and subsequently, in many cases, wrapping the core with multiple layers of other materials such as latex or leather, and then wrapping again with layers of yarn or cord in order to mitigate and/or modify the impact of the mallet head on the striking surface, which in many cases has traditionally been a rosewood bar or a bar made of some synthetic material or metal. This technique of mallet construction often results in a mallet of considerable weight. When held by the percussionist at the extreme opposite end of the mallet shaft as is the case with the four mallet grips typically taught in keyboard percussion studies (see FIGS. 2-5) and cf O'Donnell, (U.S. Pat. No. 6,924,423 B2, 2005, Drawings, Sheet 2) these traditional mallets suspend as if from a fulcrum, amplifying the effects of momentum and inertia at the mallet head end of the mallet and subsequently multiplying the difficulty with which the mallet might be manipulated by the percussionist's fingers and wrists. The present invention addresses this problem by utilizing light weight materials such as sponge rubber and synthetic materials such as polyurethane foam to comprise the mallet head, resulting in a mallet of considerably reduced weight and thus considerably enhanced control. Said construction considerations possess the further benefit of reducing muscle stress during the long periods of practice and rehearsal sessions which are commonly required in order for the student to acquire the necessary fine-motor-control skills and become proficient at the instrument. Moreover, the weight of the traditional mallet, when gripped with the butt of the unimproved mallet shaft in the palm and heel of the hand presses the unimproved mallet butt into the palm or heel with considerable pressure, often causing considerable discomfort. The lighter weight of the instant invention's lightweight mallet heads mitigates this effect. Furthermore the gripping pommels at the butt ends of the instant invention further mitigate the effects of momentum and inertia accruing from mallet head weight by mitigating the force of the mallet shaft at the point of contact with the palm of the percussionist's hand by effectively enlarging the contact area, dispersing the force of the weight and impact across a wider surface area.

Practice volume: As a general rule, there is a direct relationship between the weight of the mallet head and the volume level of sound produced when the mallet strikes the striking surface of a keyboard percussion instrument. Traditional mallets being relatively heavy, as indicated above, they tend to produce substantial volumes of sound during ordinary use. While this is a desirable characteristic in some performance situations, it can have a deleterious effect on practicing and rehearsing, which often entails a considerable degree of repetition in which notes and patterns of notes are repeated for hours on end. Such repetition at high volumes can not only produce irritation in the practitioner himself or herself but also can prove irritating to those who share practitioner's sonic space. The instant invention addresses this problem by utilizing ultra-lightweight materials as described above for the mallet head construction. This method of mallet construction produces a significantly reduced volume of sound while still producing sufficient sound from the struck instrument for the practitioner to be able to hear the tones struck and practice proficiency. It is noted that some lightweight materials, such as small hard-rubber or Nitrile heads, while being light, can also produce relatively loud volumes. The current invention addresses this problem by utilizing ultra-light polyurethane foam spheres as a mallet head in the 35-40 mm range and sponge rubber spheres in the range of 18-25 mm coated with a plasticizing or other similar coating in order to reinforce or otherwise moderately harden said spheres so as to sound bars at the desired volume. It is contemplated that other materials yielding a balance between lightness and low volumes will be discovered and applied.

PRIOR ART

Relevant prior art includes O'Donnell (U.S. Pat. No. 6,924,423 B2, 2005), Thoman (U.S. Pat. No. 6,118,062 2000), Walker (U.S. Pat. No. 7,741,552 B2, 2010), Simpson (U.S. Pat. No. 6,307,138 B1 2001), Sen (U.S. Pat. No. 5,925,840 1999), Grover (U.S. Pat. No. 7,595,442 B2, 2009), Richard (Pub No. US 2006/0027073 A1, 2006), and Mallets by the Musser and American Drum companies.

The problem of grip as pertains to percussion instruments and in particular percussion instruments meant to be struck with an implement has rightly been the focus of much discussion and controversy. O'Donnell teaches some of the specific problems pertaining to keyboard mallet percussion but his purpose in that teaching does not address the problems of grip enhancement as pertains to these instruments or the problem of volume during practice and rehearsal. Grover teaches an ergonomic drumstick with a grip member resembling something like a knob or a pommel but does not teach an application to the specific problems of keyboard percussion instruments. Walker teaches a training drumstick with a grip to 'properly orient the user's hand.' Walker does not teach a method or construction suitable for keyboard percussion instruments. Thoman and Richard both describe drumstick grips, with Richard incorporating knurled variations interspersed between the user's fingers as the user grips the drumstick. Richard and Thoman do not teach a method for applying their inventions to keyboard percussion. Simpson teaches a mallet with gripping members differentiated by dissimilar diameters, much like the two-stage Musser mallet above, with striking heads at each end of the mallet. At one end is a fibrous mallet head suitable for timpani, at the opposing end a mallet head suitable for bells or cymbals. While it is contemplated that users of the instant invention might utilize the pommelled end of the instant invention as a striking head in some instances, such as to practice orchestra bells or xylophone, such use would be limited by the limitations imposed on the size of the pommel by its primary purpose as a grip enhancing mechanism requiring it to fit comfortably in the user's hand when the user is holding two or more mallets in each hand.

A example of the importance of size as to the pommel of a pommeled mallet handle can be seen in one model of therapeutic drumming mallet made by the American Drum company. The Clive Robbins models sold by American Drum utilize a pommel at the gripping end of the drum mallet, as do many mallets made for playing the bass drum (http://americandrum.com/catalog/therapy/therapy.html). However, the size of the American Drum pommel, at three-quarters of an inch, precludes its being held comfortably in the user's palm, especially where multiple mallets are to be held in each hand and the mallets manipulated independently of one another with subtle adjustments of the fingers. The American Drum Clive Robbins model's pommel is rather a stop, a manner of assisting a therapy patient with maintaining a grip in the first instance on the mallet rather than an being an instructional aide for any particular style or mode of grip. The fact that the mallets are sold as units rather than in pairs or sets of four as is the usual case with mallets for keyboard percussion further points to its intended use as a drum mallet rather than a mallet specifically tailored for keyboard percussion.

While all of the above stress the importance of grip in the playing of percussion instruments, and Walker in particular teaches the importance of grip in the training of percussionists, none teach a grip addressing the particular needs of keyboard percussion players, i.e. that the mallet shaft remain slender enough to accommodate two mallets in each hand and simultaneously allow the percussionist to manipulate each mallet independently of the other with a minimum of interference. The instant invention addresses this problem.

Senn teaches a mallet with a lightweight, polyethylene foam head, but Senn does not contemplate a mallet head which produces a low volume sound while simultaneously remaining rigid enough to produce enough of an impact on keyboard mallet instrument bars as to produce a distinct note, or, in the parlance of the field, make the keyboard bars 'speak.' The instant invention accomplishes these objects—low volume, low weight, and simultaneously making the bars speak—through a number of different materials depending upon the user's preferences. Sponge rubber balls in the range of 18-25 mm diameter works well for practice mallet heads, as does a polyurethane or modified polystyrene foam ball where the foam is formulated or treated to maintain a substantially rigid outer shell when striking the instrument, so as to make the bar speak, while maintaining the lightness desired in a training and practice mallet. Numerous other synthetic and natural materials are contemplated as well.

BRIEF SUMMARY OF THE INVENTION

The object of the invention is to provide keyboard percussionists and keyboard percussion students with a mallet for training and practice that facilitates the learning of dual and complex multi-mallet techniques while minimizing wrist strain, increasing the surface area of the mallet member in contact with the player's hand, and reducing volume while practicing. The instant invention, a training and practice mallet for keyboard percussion instruments, accomplishes these objects with a mallet comprising a mallet handle or gripping member and a mallet head or striking member, the gripping member having a pommel, or knob, at the end-most position, where the player or user grips the mallet, and a lightweight mallet head or striking member at the opposite end. The pommel or knob may be of any of a number of materials such as a wooden bead, metal, or synthetic material and may be spherical or knurled or of any other suitable shape. The mallet head may be made of a number of materials depending upon the size of striking member desired. Polyurethane, for instance, makes a substantially rigid mallet head that will sound the keyboard bars at a low volume and remain light weight at large diameters. Sponge rubber works well at smaller diameters as does combinations of latex hose sections.

DETAILED DESCRIPTION OF THE INVENTION

Figure 1:
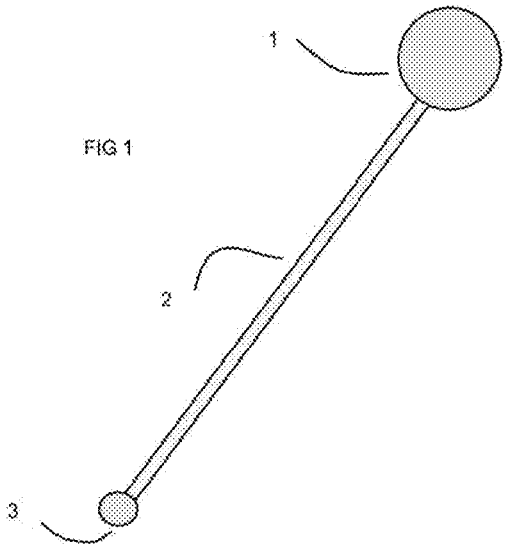
FIG. 1 is an overview of the invention.

Referring to the drawings, the preferred embodiment of the instant invention comprises a mallet for keyboard percussion instruments with a mallet head (1) of polyurethane foam, sponge rubber or other suitable material, a substantially cylindrical mallet shaft (2) of hardwood, fiberglass or other suitable material, and a pommel, or knob, (3) at the gripping end of the mallet shaft, opposite the end of the mallet from the mallet head. As noted above, the mallet head may be derived from a plethora of materials such as sponge rubber, polystyrene, etc, with the emphasis being on lightness of weight and ability to sound the bars of a keyboard mallet instrument at a reduced volume. With sponge rubber, a maximum in the range of 18-25 mm in diameter is recommended. With Polyurethane, a diameter of 35-45 mm yields enough mass to sound the bars while still retaining the desired light weight.

Figure 2:
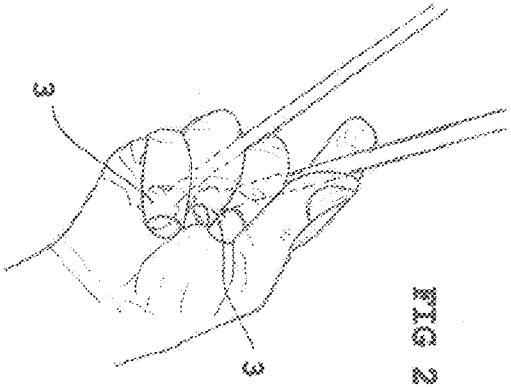
FIG. 2 shows the invention as applied to the Stevens grip, with the pommels obscured by the percussionist's fingers.
Figure 3:
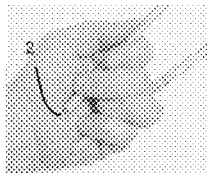
FIG. 3 is a representation of a percussionist using an unimproved mallet with a hybrid Musser/Stevens grip.
Figure 4:
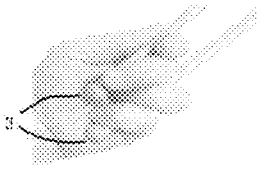
FIG. 4 is a representation of a percussionist using an improved mallet with pommels visible.
Figure 5:
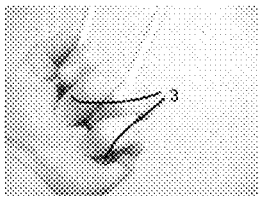
FIG. 5 is a representation of a percussionist holding an improved mallet with the pommels being wrapped in the percussionist's fingers.
Figure 6:
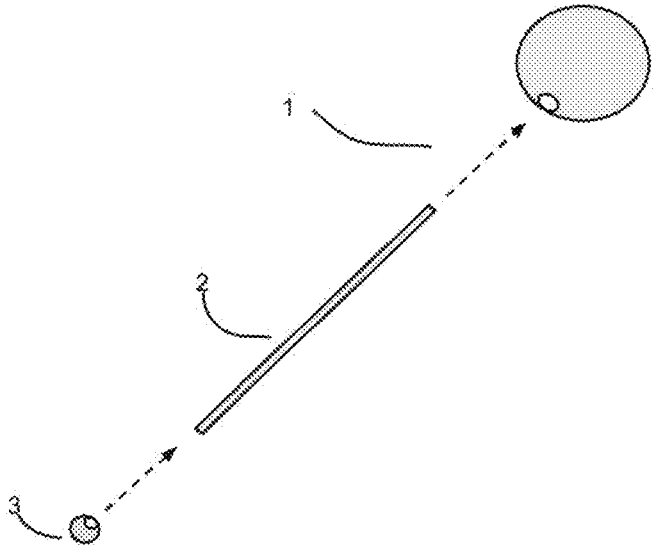
FIG. 6 is an exploded view of the invention showing apertures or openings in the pommel (3) and the mallet head (1) into which the mallet shaft (2) may inserted and fixed to form a training and practice mallet for keyboard percussion instruments.

The pommel, or knob (3), may be constructed out of an array of materials including wood (birch, etc.), plastics, aluminum, steel, synthetics such as Nitrile, etc. The pommel (3) may also be incorporated and manufactured as a piece with the mallet shaft (2) through a process of lathing or well-known injection molding methods or other suitable method. The preferred embodiment here shows a bead (3) in the range of 14 mm to 16 mm with a hollow core (FIG. 6) approximating the diameter of the mallet shaft member (2), which as noted above might range from five-sixteenths of an inch to three-eighths of an inch depending upon application. FIG. 2 shows the pommels obscured by the percussionist's hand in an illustration of the Stevens grip and illustrates the size restraints on the mallet shafts, 2, and the pommels, 3. FIG. 3 shows a percussionist holding a pair of unimproved mallets in one hand illustrating one of the problems addressed by the instant invention—that of small mallet shaft endings being grasped in the palm. FIG. 4 shows a percussionist holding a pair of improved mallets in one hand, showing the pommels and indicative of the concentration of the enhanced surface area contacting the interior portion of the percussionist's hand. It should be noted that many different shapes may be contemplated in the making and affixing of the pommels. Knurled pommels might be preferred by some percussionists. The spherical pommels shown in FIG. 4 and throughout are preferable in the uniformity of pressure and contact with the percussionist's hands, but the efficacy of the invention is not limited to a spherical shape for the pummel. FIG. 5 shows a percussionist holding a pair of improved mallets in one hand, with the pommel obscured somewhat with the percussionist's fingers wrapped around them, further illustrating the above-mentioned upward limitations on the size of the pummel. This figure shows the end-point or the ultimate goal of the instant invention—to be able to use the enhanced surface area provided by the pommel to manipulate each mallet independently of the other by means of minute alterations in finger position. The increase in surface area in contact with the hand results in increased neuro-muscular feedback and thus allows a greater degree of control while maintaining a minimum of interference between and among the multiple mallet shafts situated in the percussionist's hands. FIG. 6 illustrates one method of constructing a mallet contemplated by the instant invention. The pommel (3), comprises a small sphere with an aperture or core which may be mounted on one end of a mallet shaft member (2), providing an enhanced gripping surface. The mallet head (1), here is shown with a similar aperture into which the opposite end of the mallet shaft (2) may be fixed. The pommel (3) and mallet head (1) may be affixed to the mallet shaft (2) with adhesive, though the particular mode of fixing them, whether by threading, pressure, or well-known injection molding methods one or more members in a single piece of manufacture is left to the practitioner skilled in the art.

What is claimed is:

1. An ergonomic mallet for keyboard percussion instruments, comprising:

at least one substantially cylindrical mallet shaft member with two ends, a gripping end, a striking end, a gripping pommel affixed at the terminus of the gripping end, whereby an enhanced gripping member is provided, increasing sensory input, situational awareness, control, comfort, and confidence for students and practitioners of keyboard percussion instruments.

2. An ergonomic training and practice mallet for keyboard percussion instruments, comprising:

at least one substantially slender cylindrical mallet shaft with two ends, a gripping end, a striking end, a gripping pommel for gripping in the user's hand at the gripping end of the mallet shaft, whereby sensory input, awareness of mallet position, control and confidence are enhanced, a mallet head at the striking end, comprising a lightweight material whereby a reduced-volume sound is produced when striking the keys of a keyboard percussion instrument and whereby muscle stress during use is reduced.

3. The mallet of claim 1, wherein, the gripping pommel comprises a removable, interchangeable bead or ball or other geometric shape, including but not exhaustive of spherical, conic, cylindrical, semi-cylindrical or semi-spherical, consistent with providing an enhanced gripping member for keyboard percussion instrument mallets.

4. The mallet of claim 2, wherein, the gripping pommel comprises a removable, interchangeable bead or ball or other geometric shape, including but not exhaustive of spherical, conic, cylindrical, semi-cylindrical or semi-spherical, and consistent with providing an enhanced gripping member for keyboard percussion instrument mallets.

5. The mallet of claim 1, wherein the gripping pommel comprises interchangeable beads or pommels of varying circumferences and sizes consistent with providing an enhanced gripping member for keyboard percussion instrument mallets.

6. The mallet of claim 2, wherein the gripping pommel comprises interchangeable beads or pommels of varying circumferences and sizes consistent with providing an enhanced gripping member for keyboard percussion instrument mallets.

7. The mallet of claim 1, wherein the gripping pommel comprises of wood, metal, plastic, rubber, fabric, tape, layered coating or other suitable material consistent with providing an enhanced gripping member for keyboard percussion instrument mallets.

8. The mallet of claim 2, wherein the gripping pommel comprises of wood, metal, plastic, rubber, fabric, tape, layered coating or other suitable material consistent with providing an enhanced grip gripping member for keyboard percussion instrument mallets.

9. The mallet of claim 1, wherein the exterior portion of the gripping pommel is plasticized, rubberized, metalized, or otherwise modified with a coating or sheath consistent with providing an enhanced gripping member for keyboard percussion instrument mallets.

10. The mallet of claim 2, wherein the exterior portion of the gripping pommel is plasticized, rubberized, metalized, or otherwise modified with a coating or sheath consistent with providing an enhanced gripping member for keyboard percussion instrument mallets.

11. The mallet of claim 1, wherein the gripping pommel comprises an integral part of the mallet shaft as a result of injection molding or other method of molding or extruding, machining, or otherwise manufacturing the mallet shaft and pommel as one piece.

12. The mallet of claim 2, wherein the gripping pommel comprises an integral part of the mallet shaft as a result of injection molding or other method of molding or extruding, machining, or otherwise manufacturing the mallet shaft and pommel as one piece.

13. The mallet of claim 2 wherein the exterior of the mallet head is reinforced, by means of a reinforcing or hardening agent or coating, providing a means of sounding the instrument to the user's requirements.

14. The mallet of claim 1 wherein the gripping pommel is coated with a plasticizing or rubberizing solution, providing a furtherly enhanced gripping member.

15. The mallet of claim 1 wherein the gripping pommel is coated with a plasticizing or rubberizing solution, providing a furtherly enhanced gripping member.

16. A means of modifying existing mallets for keyboard percussion instruments, comprising;

affixing thereto at the gripping end of the mallet a gripping pommel whereby the circumference of the grip end of the mallet is modified to enhance sensory input and comfort consistent with providing an enhanced gripping member for keyboard percussion mallets.

17. The mallet of claim 2 with no gripping pommel.

* * * * *